US008677639B2

(12) United States Patent
Neubauer et al.

(10) Patent No.: US 8,677,639 B2
(45) Date of Patent: Mar. 25, 2014

(54) SKI POLE WITH INCLINOMETER

(75) Inventors: Jason Neubauer, Redmond, WA (US); Douglas Sanders, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 131 days.

(21) Appl. No.: 13/276,985

(22) Filed: Oct. 19, 2011

(65) Prior Publication Data

US 2012/0174420 A1 Jul. 12, 2012

Related U.S. Application Data

(60) Provisional application No. 61/405,432, filed on Oct. 21, 2010.

(51) Int. Cl.
*G01C 9/28* (2006.01)
*A63C 11/26* (2006.01)

(52) U.S. Cl.
USPC ..... 33/334; 33/379

(58) Field of Classification Search
USPC ..... 33/333, 334, 379; 280/819, 821
See application file for complete search history.

(56) References Cited

U.S. PATENT DOCUMENTS 3,306,618 A * 2/1967 Liljequist ..... 33/334
4,932,133 A * 6/1990 Bruhn ..... 33/377
5,112,053 A * 5/1992 Brucker ..... 33/334
5,632,484 A * 5/1997 Lambert ..... 33/334
2002/0017029 A1* 2/2002 Beyer ..... 33/379
2008/0155843 A1* 7/2008 Yun ..... 33/333
2009/0250917 A1* 10/2009 Lenhart ..... 280/821
2012/0080064 A1* 4/2012 Gorey et al. ..... 280/819

OTHER PUBLICATIONS

Extended European Search Report mailed Jan. 25, 2012, issued in corresponding European Application No. 11 185 936.9, filed Oct. 20, 2011, 9 pages.

"PIEPS 30° PLUS Clinometer Goniometer," Technical Data Sheet, Oct. 27, 2010, PIEPS GmbH, Lebring, Austria, <http://www.pieps.com/fr/safety-equipment/pieps-30d-plus> [retrieved Jan. 12, 2012], 2 pages.

"Premium Alpine Performance," Neuheit 2009 Catalog, Apr. 2, 2009, PIEPS GmbH, Lebring, Austria, <http://www.saac.at/web/media/custom/files/Neuheiten_PIEPS_A4 EV.pdf> [retrieved Jan. 12, 2012], 2 pages.

Robanna, "Ski Pole Inclinometer," May 17, 2010, <http://www.instructables.com/id/Ski-Pole-Inclinometer-1/> [retrieved Jan. 13, 2012], 1 page.

"Slope Meter," backcountryaccess.com: Products/Snow Study Tools, May 27, 2010, Backcountry Access, Inc., Boulder, Colo., <http://www.bcaccess.com/bcastore/english/products/product_detail.php-?productID=78767> [retrieved Jan. 13, 2012], 1 page.

* cited by examiner

*Primary Examiner* — G. Bradley Bennett
(74) *Attorney, Agent, or Firm* — Christensen O'Connor Johnson Kindness PLLC

(57) ABSTRACT

A ski pole is disclosed. The ski pole includes a ski pole shaft and a ski pole grip. The ski pole includes an inclinometer mounted to the ski pole shaft or grip, wherein the inclinometer is configured to be integral to the shaft or the grip.

11 Claims, 10 Drawing Sheets

SKI POLE WITH INCLINOMETER

CROSS REFERENCE TO RELATED APPLICATION

This application claims the benefit of U.S. Provisional Application No. 61/405,432, filed on Oct. 21, 2010, fully incorporated herein expressly by reference.

BACKGROUND

An inclinometer is an instrument that measures the angle of sloping terrain, such as hills and mountains. Skiers are particularly interested in knowing the angle of a slope before skiing it. Knowing the angle of a ski slope will assist the skier in determining whether the snow covering the slope has the possibility of creating an avalanche. It is known that avalanches tend to occur within a certain range of slope angles. It would also be useful to know the angle of a ski slope so that a skier can determine whether the steepness of the slope is within the skier's capabilities. Determining the angle of a slope can be difficult without the proper equipment. Disclosed is an apparatus that provides advantages in view of prior inclinometers.

SUMMARY

In a first embodiment, a ski pole is disclosed. The ski pole includes a ski pole shaft, a grip attached to the shaft, and an inclinometer mounted to the ski pole shaft or grip, wherein the inclinometer is configured to be integral with the shaft or the grip. In one embodiment of the ski pole, the inclinometer is generally non-removable from the ski pole.

In any embodiment of the ski pole, the inclinometer can be configured to be inclined greater than 0 degrees with respect to the ski pole or ski grip.

In any embodiment of the ski pole, the inclinometer may include an arc-shaped liquid-filled vial with markings to indicate the angle of sloping.

In any embodiment of the ski pole, the inclinometer may include more than one liquid-filled vials.

In any embodiment of the ski pole, the inclinometer may include more than one liquid-filled vials, and each one of the more than one vials are straight and placed at a different angle with respect to each other.

In any embodiment of the ski pole, the inclinometer may include a projecting part that mates with a matching part on the grip to prevent rotation of the inclinometer.

In any embodiment of the ski pole, the inclinometer includes an electronic tilt sensor.

In any embodiment of the ski pole, the inclinometer may have a scale of slope angles from approximately 30 degrees to approximately 48 degrees.

In any embodiment of the ski pole, the inclinometer may have a scale of slope angles from approximately 35 degrees to approximately 45 degrees.

In any embodiment of the ski pole, the inclinometer may include two slope angle readings of about 30 and about 48 degrees.

In any embodiment of the ski pole, the inclinometer may include two slope angle readings of about 35 and 45 degrees.

In any embodiment of the ski pole, the grip and inclinometer can be molded from a single piece of flexible plastic.

It should be understood that any one or more of the features described above further describing the ski pole of the first embodiment can be combined with any one or more of the other features.

In a second embodiment, a ski pole is disclosed. The ski pole includes an inclinometer connected to the ski pole, the inclinometer comprising a first indicator of a low slope angle, and a second indicator of a high slope angle.

In any embodiment of the ski pole, the inclinometer may include a first straight liquid-filled vial for the low slope angle indicator and a second straight liquid-filled vial for the high slope angle indicator.

In any embodiment of the ski pole, the inclinometer may have the low slope angle at about 30 degrees or about 35 degrees.

In any embodiment of the ski pole, the inclinometer may have the high slope angle is about 45 degrees or about 48 degrees.

It should be understood that any one or more of the features described above further describing the ski pole of the second embodiment can be combined with any one or more of the other features.

In a third embodiment, a method for measuring the angle of a slope is disclosed. The method includes providing a ski pole with an inclinometer, placing the ski pole lengthwise on the ground of the slope to be measured, wherein ends of the ski pole point to respective high and low elevations, and reading an indication of slope angle from the ski pole.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
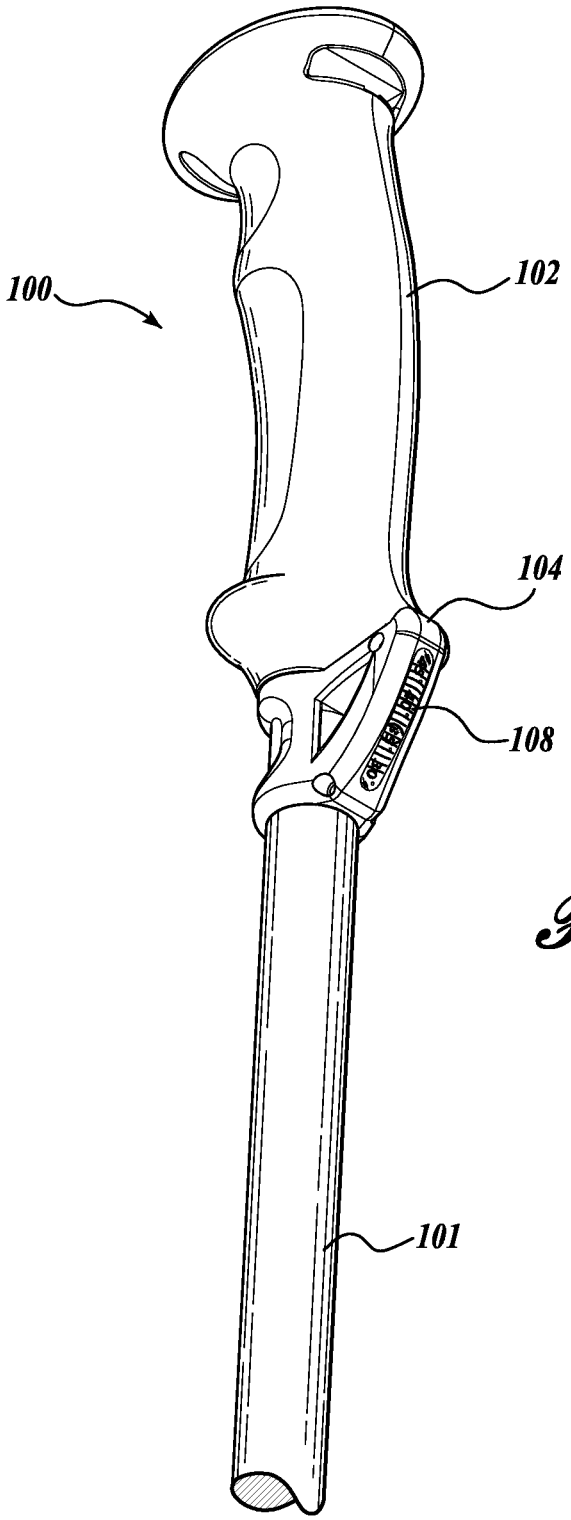
FIG. 1 is a diagrammatical illustration of a ski pole with an inclinometer.
Figure 2:
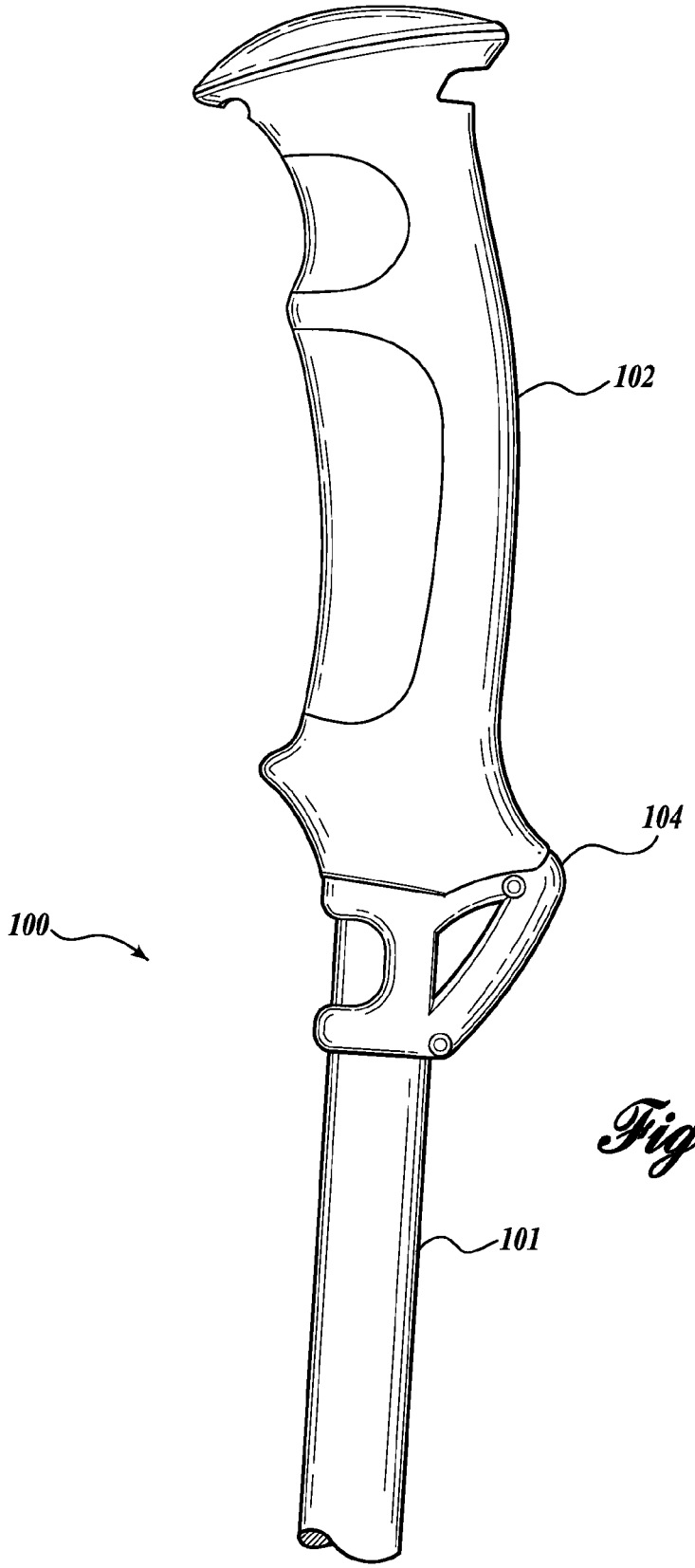
FIG. 2 is a diagrammatical illustration of a ski pole with an inclinometer.
Figure 3:
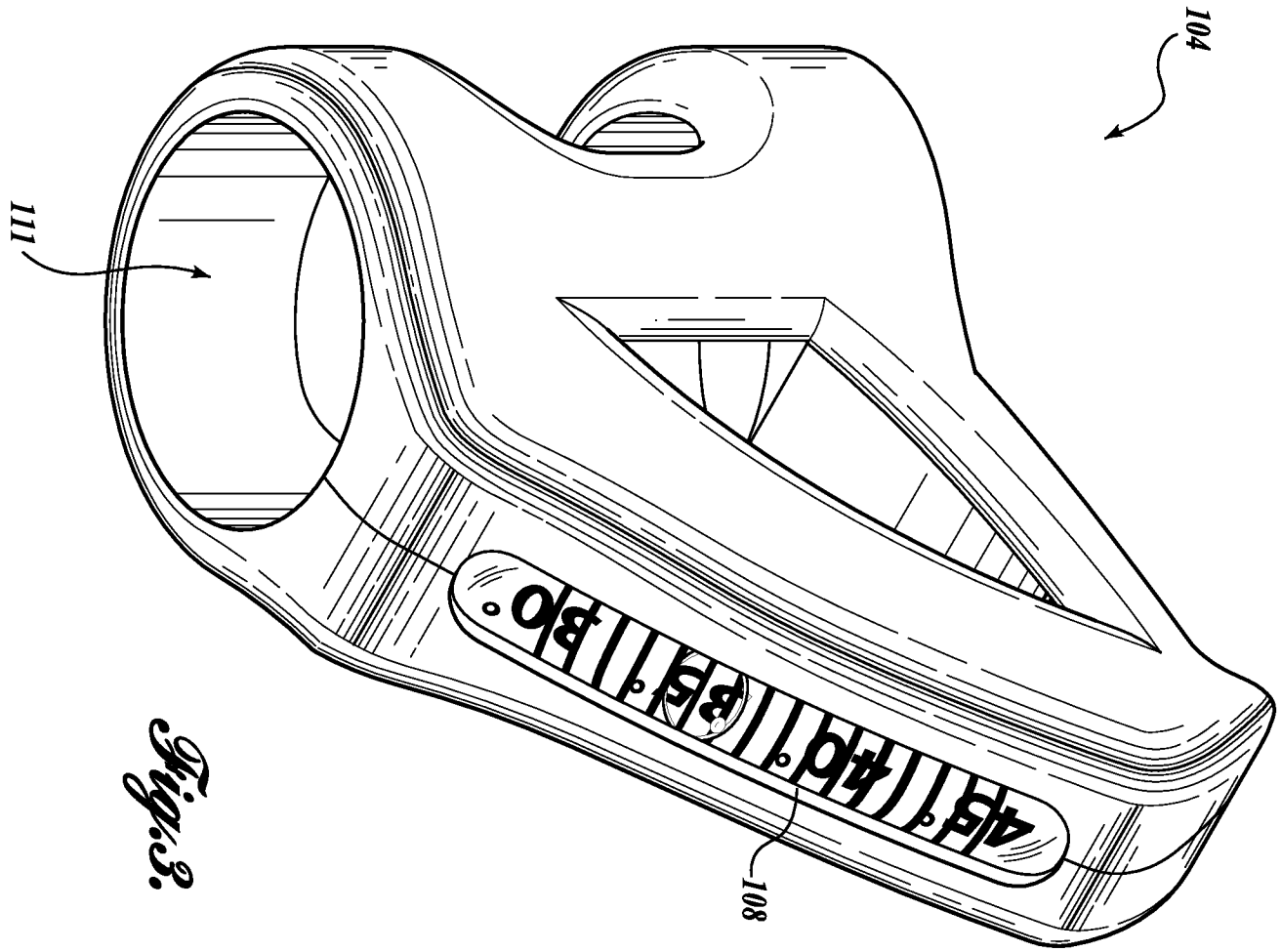
FIG. 3 is a diagrammatical illustration of a perspective view of an inclinometer.

FIGS. 1, 2, 7, and 8 show a ski pole 100 having an inclinometer 104 attached to the ski pole 100. A ski pole 100 includes a shaft 101 and a ski pole grip 102. It is understood that the ski pole 100 may also include a ski tip and basket. The shaft 101 is usually made from wood, fiberglass, carbon or metals, such as aluminum. The grip 102 is usually a molded plastic material. In accordance with one embodiment, an inclinometer 104 is provided on the ski pole 100. In one embodiment, the inclinometer 104 is juxtaposed next to and below the ski pole grip 102. In one embodiment, the inclinometer 104 includes a portion designed to clasp around the shaft 101. A second portion of the inclinometer 104 connected to the clasping portion is configured to hold a liquid-filled vial 108 with a bubble, as best seen in FIG. 3. The vial includes a viewing area with markings to indicate the angle of sloping. The liquid is preferably resistant to freezing and remains liquid at low temperatures. A suitable liquid can include an oil or, alternatively, an alcohol. From a side profile, when mounted on the ski pole 101, the liquid-filled vial 108 has an arc shape that allows the bubble to rise and fall within the vial 108 depending on the angle position of the ski pole 100. The vial 108 describes a centerline that passes through the center of the vial 108. The vial centerline is positioned at an angle relative to the longitudinal axis of the ski pole 100. The angle that the vial 108 makes with the ski pole axis and the radius of the arc determine the slope angles that can be measured with the inclinometer 104. For example, a steeper vial angle with respect to the ski pole will mean that the inclinometer will be able to measure slopes in the higher range of slope angles. A smaller radius, i.e., more curvature of the vial 108 will mean that the range of slope angles measurable by the inclinometer will be greater than if the radius were larger, i.e., less curvature. It should be noted that a perfectly straight vial, without any curvature, will only indicate very small angles and whether or not the ground is level. This is the principle of the common level.

Figure 5:
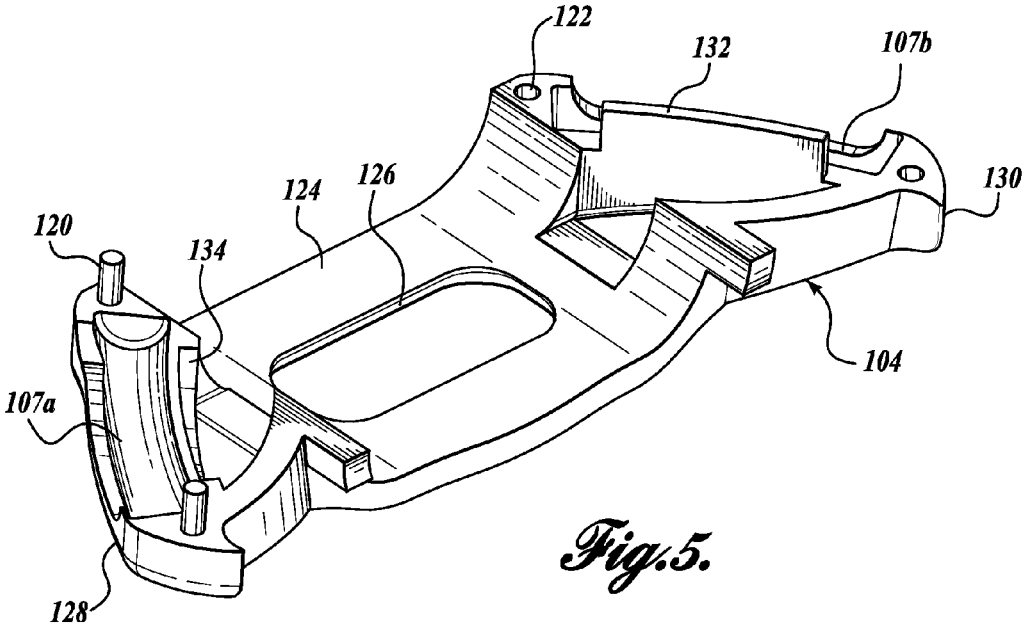
FIG. 5 is a diagrammatical illustration of a perspective view of a housing of an inclinometer.
Figure 6:
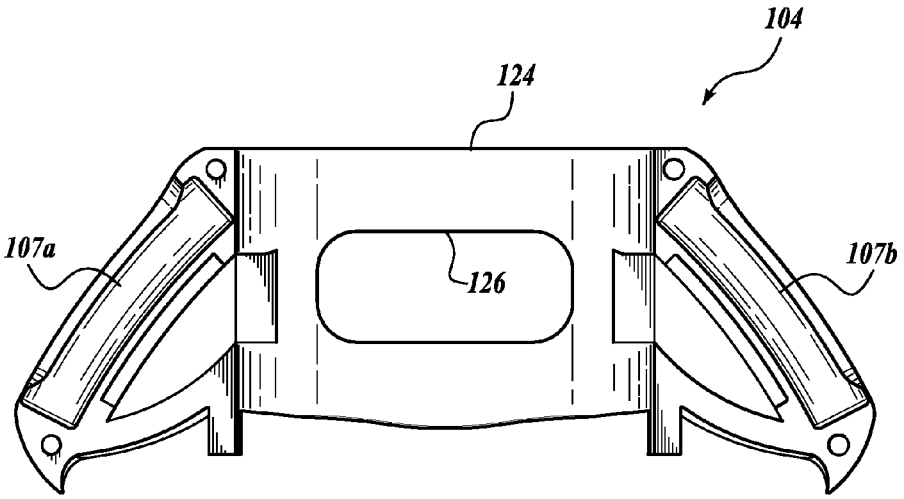
FIG. 6 is a diagrammatical illustration of a plan view of a housing of an inclinometer.

Referring to FIGS. 5 and 6, in one embodiment, the inclinometer is made from a housing 104. The housing 104 is fabricated from a unitary injection molded plastic piece. The plastic may be flexible. The housing is formed from two minor image halves, except that one half may have pegs 120 and the other half may have holes 122 so that the halves may be brought together and attached to each other. The housing piece has a flat center 124 that forms the opening 111 (as seen in FIG. 3) that allows the housing piece to be wrapped around the ski pole shaft 101. The flat center 124 may have a cutout 126 that facilitates flexing of the housing around the ski pole shaft 101. The housing piece has a first 128 and second 130 flap extending from the center 124 on opposite sides thereof. Each flap 128, 130 includes an arc-shaped cutout 107*a* and 107*b* that will be used to house the liquid filled vial 108. The flap 130 has a long narrow peg 132 extending below the cutout 107*b*, which is received within a matching indentation 134 below the cutout 107*a* in the flap 128. The housing piece 104 may be wrapped around the ski pole shaft 101 and fastened by inserting the pegs 120 into holes 122 and the peg 132 into indentation 134. The two cutouts 107*a, b* form the cavity for the vial 108. In one embodiment, the housing 104 is made of flexible plastic that allows inserting the vial 108 within the cavity is formed by joining the two halves. Alternatively, the inclinometer 104 may be constructed, for example, from two separate halves of molded plastic that are not so flexible to allow inserting the vial after assembly.

In such case, the two halves are assembled to clasp around the shaft portion 101 of the ski pole 100, while at the same time also encasing the vial 108. In yet another embodiment, the inclinometer 104 may be constructed from a single piece of molded flexible plastic. Once the piece is removed from the tool, leaving a cavity, the vial 108 is snapped into the negative draft cavity. The flexible plastic allows for this to be done. A single piece prevents two halves from being opened unintentionally, such as from an impact.

Figure 4:
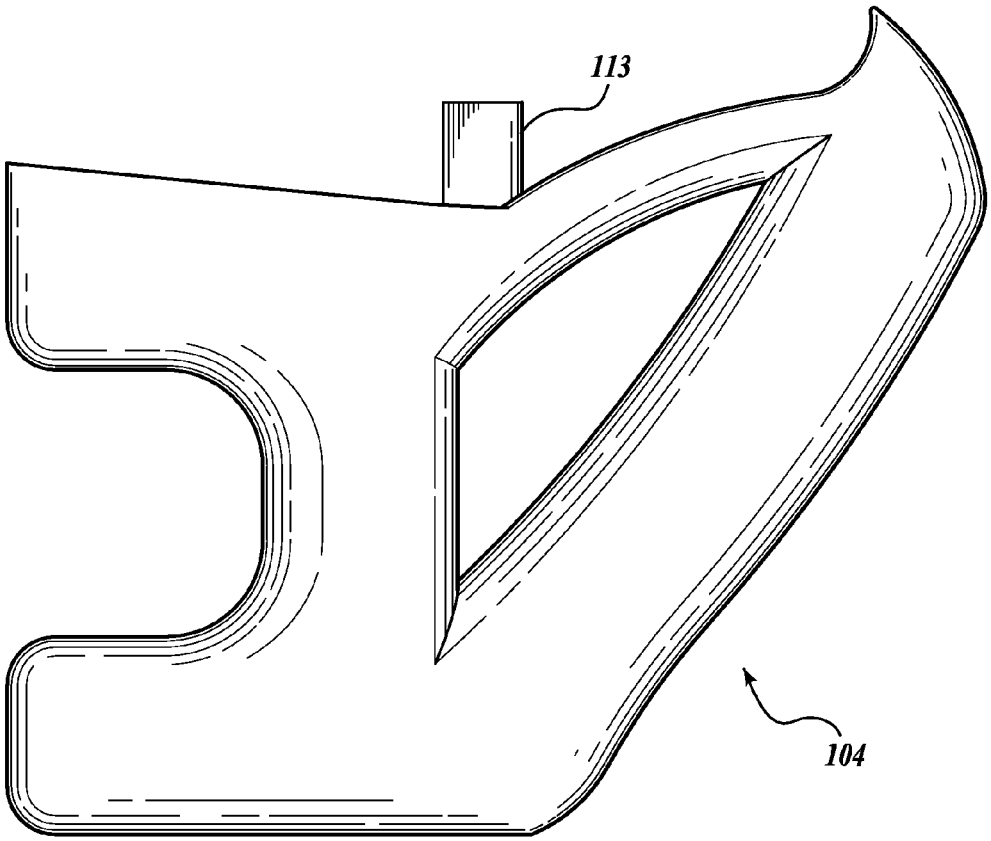
FIG. 4 is a diagrammatical illustration of a side view of the inclinometer of FIG. 3.

In one embodiment, the inclinometer is designed to fit next to the end of the ski grip 102 that faces toward the ski pole tip. For this purpose, the inclinometer 104 can have a profile, as best seen in FIG. 4, that matches the profile of the ski grip 102 where the inclinometer 104 is juxtaposed next to the ski grip 102. Additionally, the inclinometer 104 can include a projecting part 113, as seen in FIG. 4, on the side juxtaposed next to the ski grip 102 that fits within an aperture provided in the ski grip 102 to prevent the inclinometer 104 from rotating around the shaft 101. Alternatively, a ski grip 102 can be fabricated integrally with the inclinometer housing or the ski grip 102 can include the projecting part and the housing can include the aperture.

Figure 7:
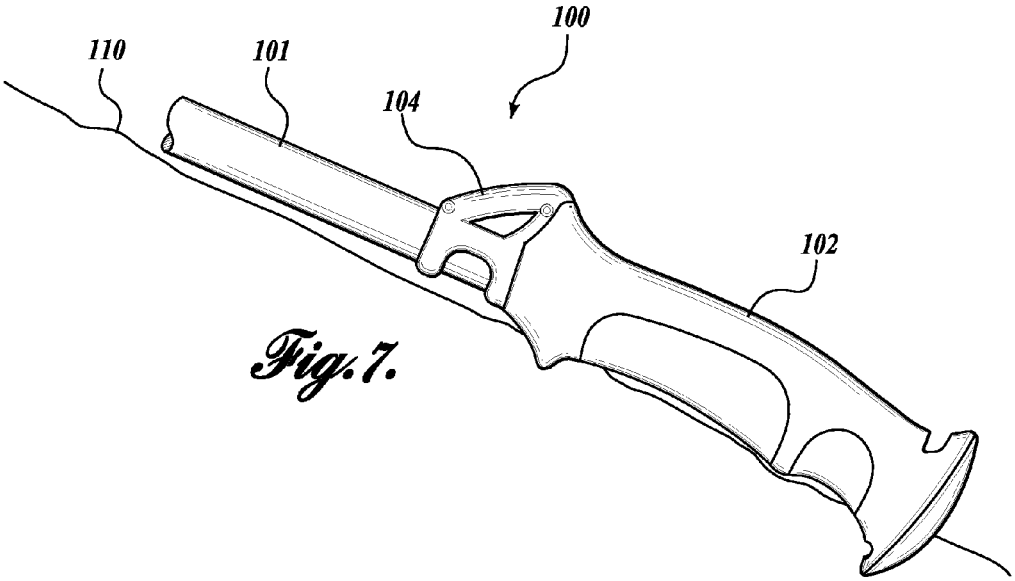
FIG. 7 is a diagrammatical illustration of a ski pole with inclinometer used to measure the angle of sloping.
Figure 8:
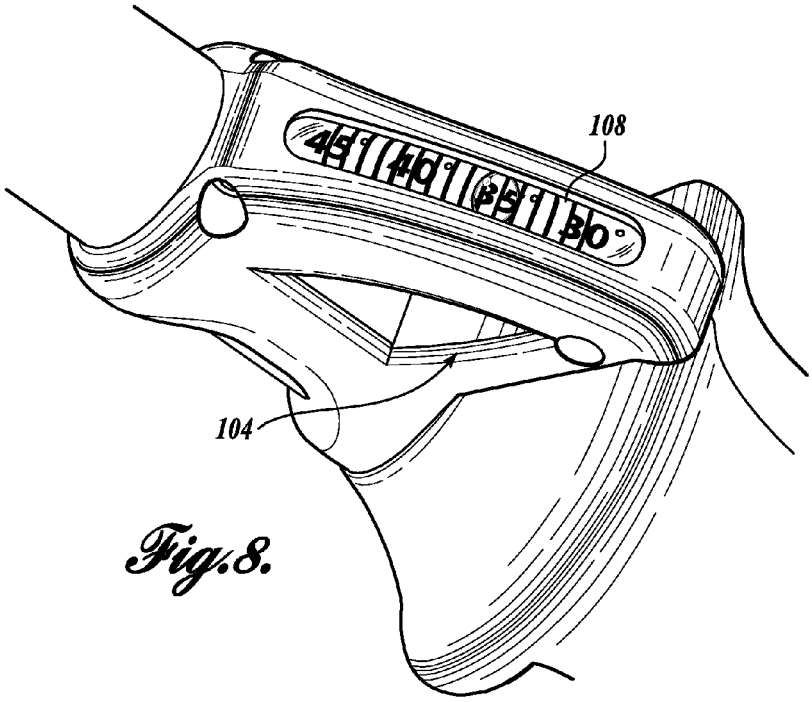
FIG. 8 is a diagrammatical illustration of a ski pole with an inclinometer.

In use, an inclinometer generally needs a flat base to lie on the terrain to measure the slope of the terrain. Referring to FIG. 7, in the present embodiment, the ski pole 100 functions as the flat base. The ski pole 100 provides a suitable base because the length of the ski pole allows measuring the angle over a greater length of terrain, and not at a single point on the ground. Generally, the angle of sloping will be more representative of the true angle if the ground covered by the inclinometer base is greater. The ski pole 100 provides such a base. In measuring the slope angle, the ski pole 100 is placed lengthwise on the ground of the slope to be measured, wherein ends of the ski pole 100 point to respective high and low elevations. The ski pole 100 may have an indicator such as an arrow indicating which end, either the ski tip or ski grip, should point to the higher elevation or the lower elevation. The skier will then simply read the slope angle from the ski pole 100. The incorporation of an inclinometer with the ski pole is advantageous since the skier will already be carrying the ski pole 100 and does not need to bring an additional measuring device. Furthermore, the angle of the slope can be measured while being directly on the slope and does not rely on being further away to view the slope from a distance. The ski pole 100 with inclinometer 104 can be placed to lie on the terrain, such that the inclinometer is positioned upright so that the vial can be visible as seen in FIG. 8. While FIG. 8 shows one embodiment of an inclinometer 104, any of the embodiments of the inclinometer disclosed herein may be used on the ski pole to measure the angle of sloping. The bubble will reach a point within the arc shaped vial 108 that corresponds to the angle of sloping. The vial 108 can have markings indicating the slope angle. The vial 108 can be made form a transparent material that allows the bubble to be viewed within the vial 108. Suitable materials from which to make the vial 108 are transparent plastics, such as acrylics (polymethylmethacrylate), cellulose acetate butyrate, polycarbonate, and glycol modified polyethylene terephthalate. Glass is also suitable. The point where the bubble comes to rest will indicate the slope angle by simply reading the markings on the vial 108. In the embodiment shown, where the angle of the vial 108 is greater than 90 degrees, but less than 180 degrees, with respect to the forward ski pole shaft 101, the ski pole tip needs to face up the slope directed at the peak, while the ski pole grip 102 faces down the slope in order to get a proper reading. However, in another embodiment, the vial 108 can slope in the direction toward the tip of ski pole shaft 101, opposite to what is shown in FIG. 8.

In one embodiment, the range of angles being measured by the inclinometer 104 can include the range from approximately 30 to approximately 48 degrees. The majority of avalanches occur on slopes having an angle within the range of about 35 degrees to about 48 degrees. This is because snow will slough off very steep angles greater that 48 degrees and snow will not slough off less inclined slopes of less than 35 degrees. However, in the range of approximately 35 to 48 degrees, the angle is not steep enough for snow to slough off, but instead it accumulates, and any trigger event may cause the snow to slough off suddenly causing an avalanche. Accordingly, it is useful to determine whether the slope to be skied falls within such range.

Figure 9:
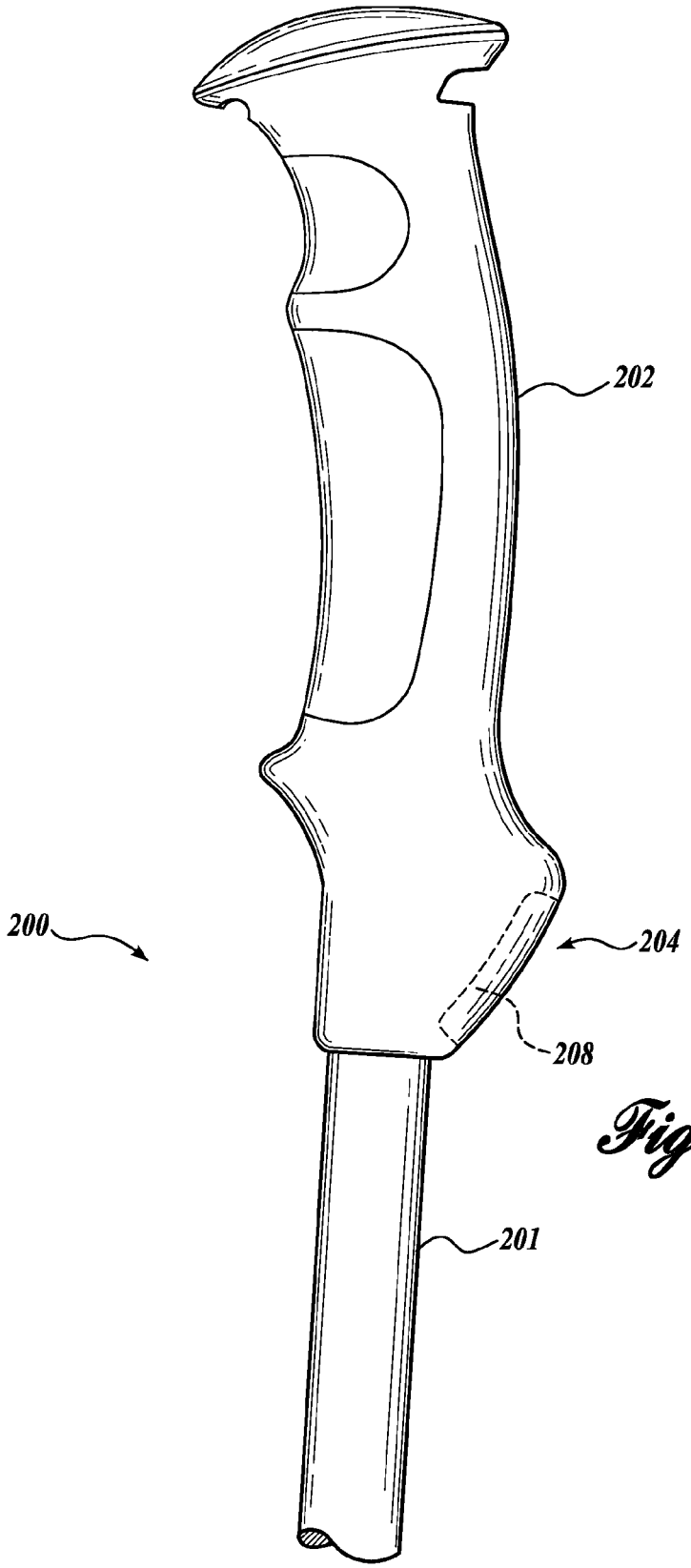
FIG. 9 is a diagrammatical illustration of a ski pole and ski grip with an inclinometer.

In another embodiment as seen in FIG. 9, the inclinometer 204 is integrated with the ski pole grip 202. In the embodiment shown in FIG. 1, the inclinometer 104 can be molded separate from the grip 102. Alternatively, in FIG. 9, the inclinometer 204 can be molded integral with the plastic grip 202. The ski grip 202 includes an arced vial 208 with which to measure the angle of sloping.

Figure 10:
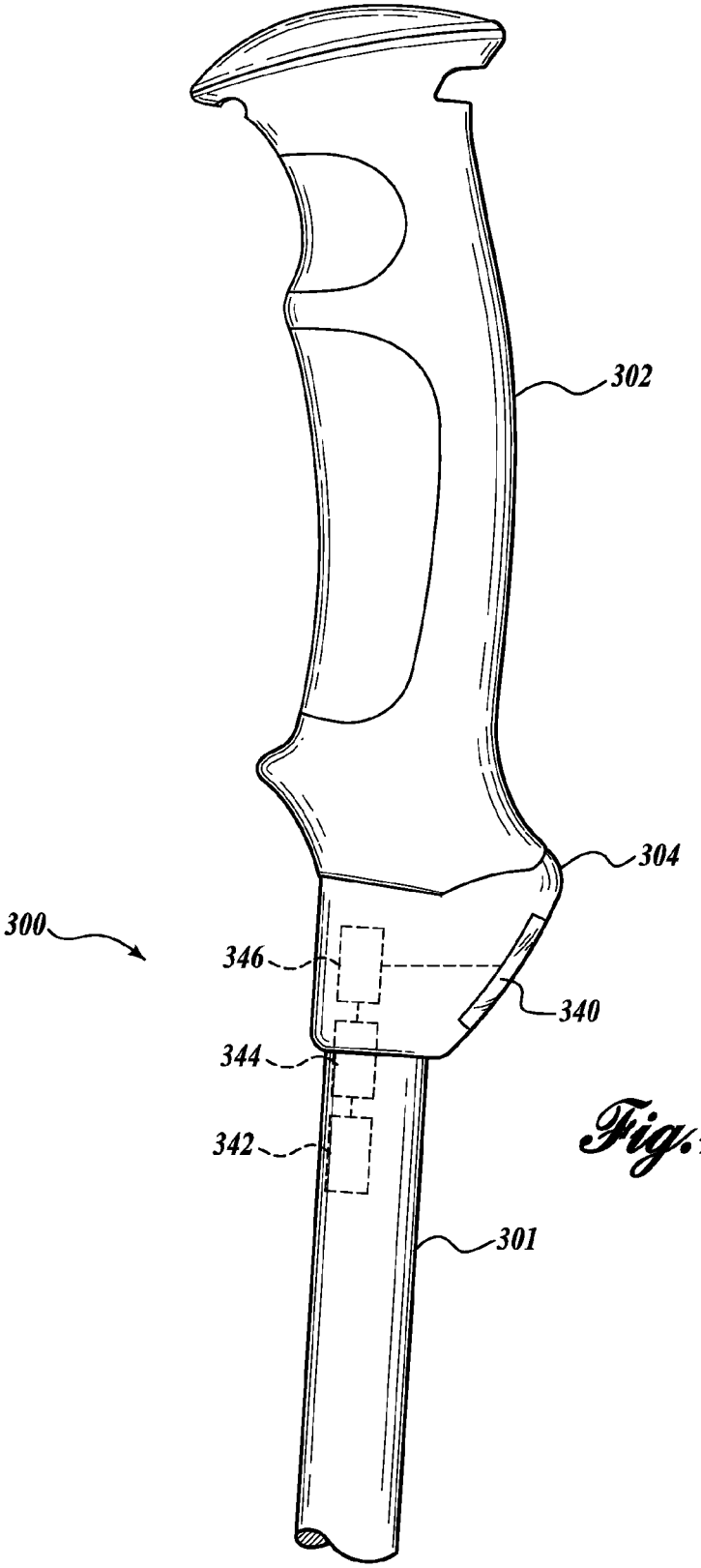
FIG. 10 is a diagrammatical illustration of a ski pole and ski grip with an electric sensor inclinometer.

In another embodiment as seen in FIG. 10, the inclinometer 304 can use an electronic tilt sensor 344. One or more sensors 344 can fit inside the shaft 301 or grip 302 and a digital display 340 can be provided in the ski pole grip 302. Electronic tilt sensors, such as 344, can be small cylinders with a metal ball that rolls inside the cylinder and makes contact to close a switch when at a predetermined angle. Two or more of these sensors can be mounted in the ski 300 to provide an indication of the safe angles. Other technologies for electronic tilt sensors 344 include accelerometers, liquid capacitive sensors, and electrolytic sensors. An electrolytic tilt sensor includes conductors within an electrolyte-filled capsule. The electrolyte fluid is electrically conductive. The conductivity between two or more of the conductors within the capsule varies proportionally in relation to the length of the conductor in contact with the electrolyte. If two sensors are unequally submerged in the electrolyte, the conductivity will vary, and this difference can be used to compute the slope angle. In this embodiment, the ski 300 may also include a power source 342 to power the tilt sensor 344 and a processor 346 to process electronic signals from the sensor 344 into a measure of slope angle. The processor 346 also sends a signal to the display 340, which then displays the slope angle.

Figure 11:
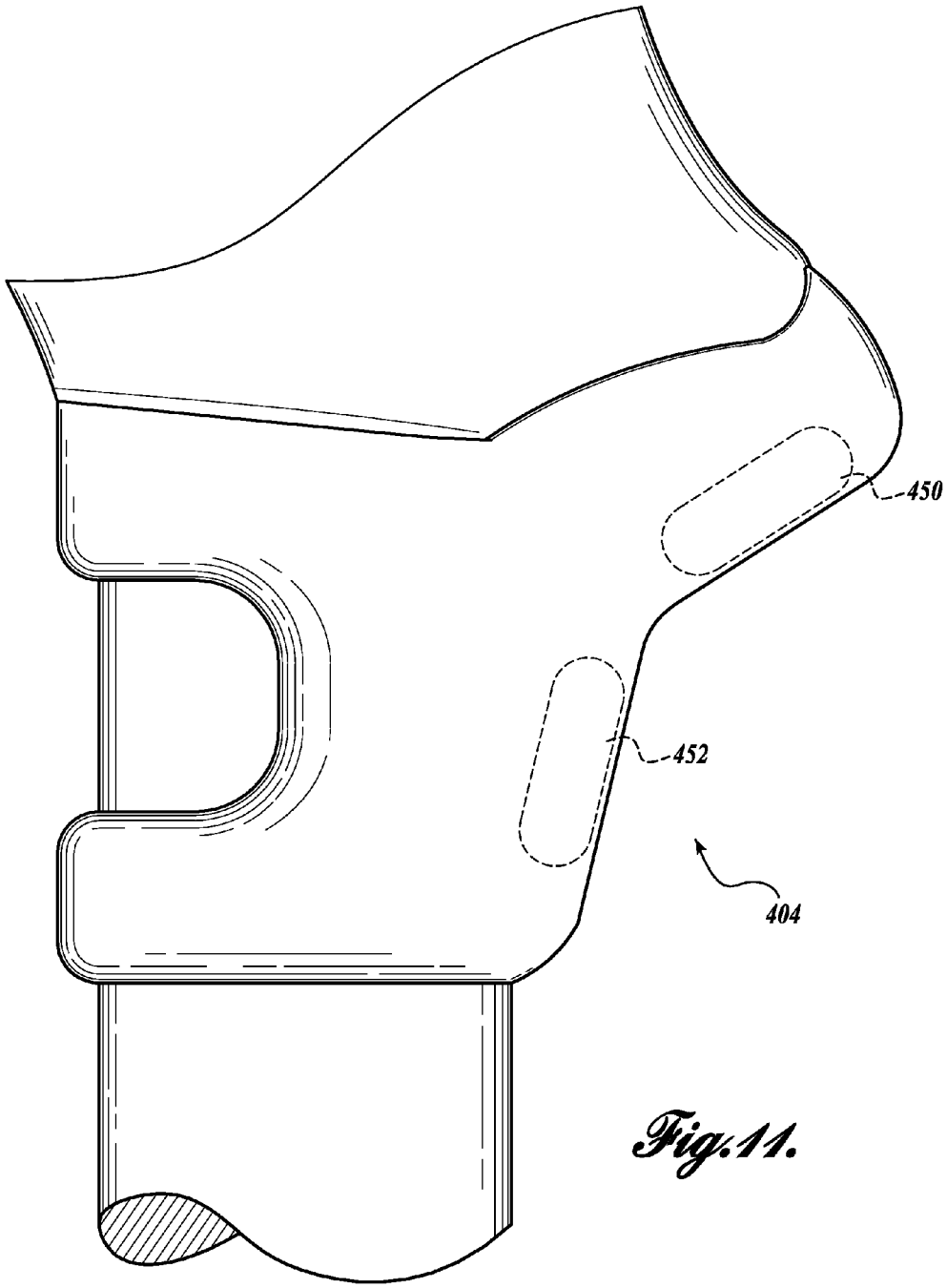
FIG. 11 is a diagrammatical illustration of an inclinometer with two vials.

In another embodiment shown in FIG. 11, the inclinometer 404 may include a plurality of liquid-filled vials 450 and 452. For example, since the majority of avalanches tend to occur within a low and high angle, corresponding to approximately 30 degrees approximately 48 degrees, in one embodiment two indicators are provided for a low slope angle and a high slope angle. Vial 452 is provided to indicate that the slope angle being measured is greater than the low limit, such as about 30 degrees and the second vial 450 to indicate that the slope is greater than the high limit, such as about 48 degrees. This embodiment provides a simple "go" or "no go" reading for the skier. In this embodiment, unlike the vial 108, the vials 450 and 452 can be straight without any curvature. Each of the plurality of vials 450 and 452 can be placed on the ski pole at a predetermined angle such as 30 and 48, or 60 and 42 degrees. The angles can be defined by the centerline of the vials 450, 452, and the centerline of the ski pole or shaft. Furthermore, the ski pole may have an indicator that instructs the skier in which direction to point the ski pole. For example, the ski pole tip may face down the slope or the ski pole tip may face up the slope. How the ski pole is placed, will determine whether to slope the vials toward the ski grip or the ski tip. Furthermore, because the vials 450 and 452 are straight and therefore generally indicate a single slope angle, the viewing area of the vials 450 and 452 can be limited to show only the portion of the vial when the bubble exceeds the desired slope angle. Furthermore, a brightly colored buoyant ball may be used inside the vial instead of a bubble. This allows the brightly colored ball to appear in the restricted viewing area only when the slope angle exceeds the angle that the vial was intended to measure.

Figure 12:
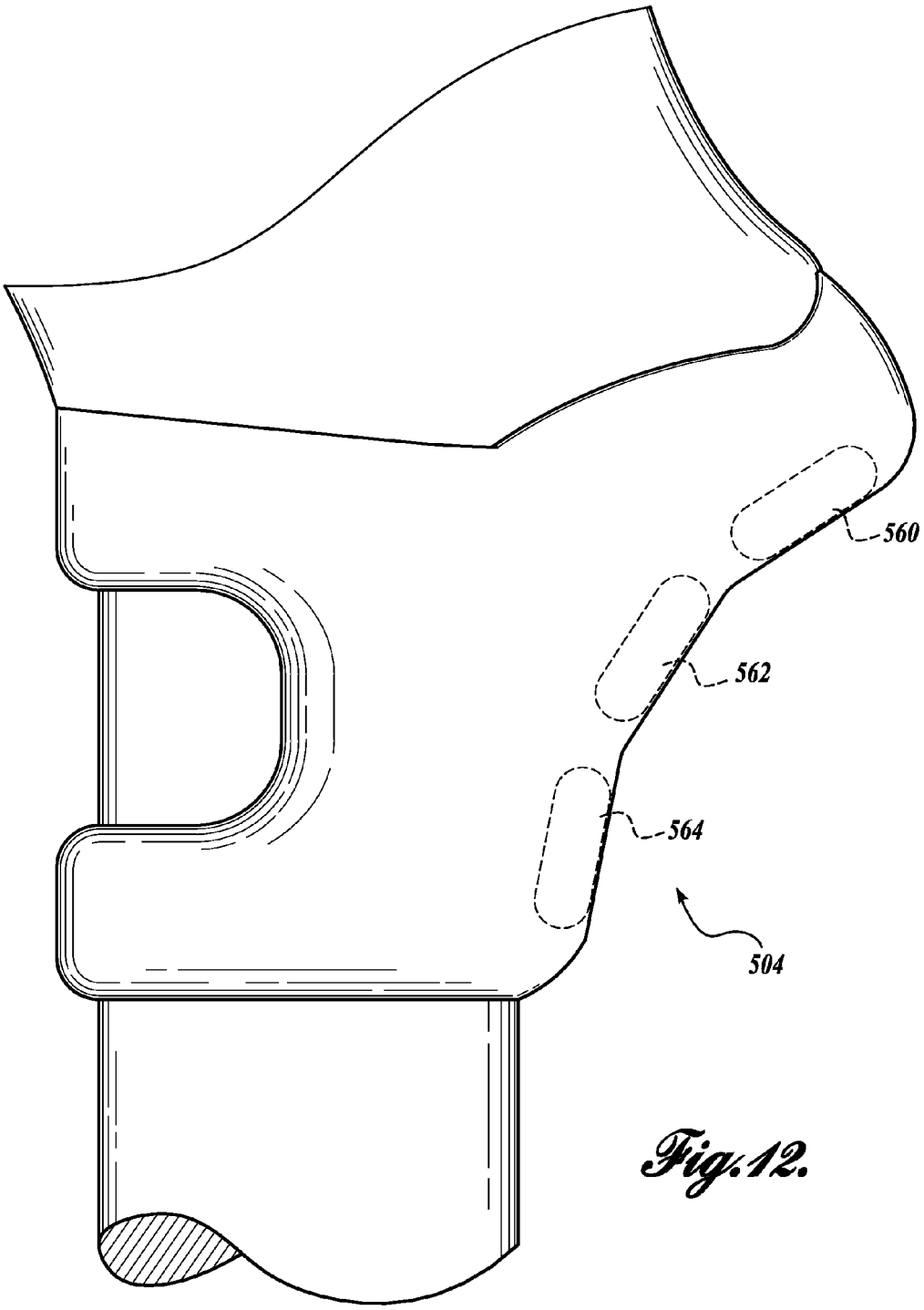
FIG. 12 is a diagrammatical illustration of an inclinometer with three vials.

In another embodiment shown in FIG. 12, three liquid-filled vials can be provided. For example, a first 560, a second 562, and a third 564 liquid-filled vial can be provided. Vial 560 may be placed at 45 degrees, the second vial 562 at 30 degrees, and the third vial 564 at 15 degrees. In this embodiment, the vials 560, 562 and 564 can be straight without any curvature. Each of the plurality of vials 560, 562 and 564 can be placed on the ski pole at a predetermined angle. The bubble will rise to the top of the vials when the terrain slope is greater than the slope of the respective vial. In these embodiments, the inclinometer does not indicate the precise angle of slope, but instead determines whether the slope is greater than a threshold slope angle. The angles can be defined by the centerline of the vials 560, 562, and 564 and the centerline of the ski pole or shaft. Furthermore, the ski pole may have an indicator that instructs the skier in which direction to point the ski pole. For example, the ski pole tip may face down the slope or the ski pole tip may face up the slope. How the ski pole is placed, will determine whether to slope the vials toward the ski grip or the ski tip. Furthermore, because the vials 560, 562 and 564 are straight, and therefore generally indicate a single slope angle, the viewing area of the vials 450 and 452 can be limited to show only the portion of the vial when the bubble exceeds the desired slope angle. Furthermore, a brightly colored buoyant ball may be used inside the vial instead of a bubble. This allows the brightly colored ball to appear in the restricted viewing area only when the slope angle exceeds the angle that the vial was intended to measure.

It should be appreciated that the inclinometers 204, 304, 404, and 504, similar to the inclinometer 104, can be separate from the ski pole and ski grip or can be formed integrally with the ski pole or ski grip. Furthermore, the inclinometers are used to measure the slope angle similarly by placing the ski pole lengthwise on the ground of the slope to be measured, wherein ends of the ski pole point to respective high and low elevations. The ski pole may have an indicator, such as an arrow indicating which end, either the ski grip or the ski tip, should point to the higher elevation or the lower elevation. The skier will then simply read the slope angle from the ski pole.

In another embodiment, the inclinometer can be a Well's inclinometer. In this embodiment, instead of using vials the inclinometer uses a hollow disc half filled with liquid. Markings are placed around the circumference of the disc. One side of the disc may be transparent to enable viewing the level of the liquid inside the disk. The disk is placed on the ski pole such that the flat surface of the disc is upright when measuring the angle of slopes. The liquid level inside the disc adjusts to the angle of the slope. The angle of the slope is read by reading the angle corresponding to the liquid level.

In another embodiment, the inclinometer can be a swing-type pendulum within a housing. In this embodiment, the inclinometer includes a scale showing the degrees of inclination. A pendulum with a pointer on the end is allowed to swing freely above the scale. Placing the ski pole on the terrain results in the pendulum adjusting to the slope angle. The angle can be read from the scale.

The ski pole with inclinometer may be used in calculating the risk of avalanches. Also, the ski pole with inclinometer provides an advantage to stand alone inclinometers because the ski pole is longer, thus providing greater accuracy in measuring the angle because of the length of the ski pole covers more ground and thus is more representative of the true slope angle.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A ski pole, comprising:

a ski pole shaft;

a grip attached to the shaft; and an inclinometer mounted to the ski pole shaft or grip, wherein the inclinometer comprises an arc-shaped vial and has a range of measurement of an angle of sloping of any angle between 30 and 48 degrees.

2. The ski pole of claim 1, wherein the inclinometer is configured to be inclined greater than 0 degrees with respect to the ski pole or ski grip.

3. The ski pole of claim 1, wherein the inclinometer comprises an arc-shaped liquid-filled vial with markings to indicate the angle of sloping.

4. The ski pole of claim 1, wherein the inclinometer comprises more than one liquid-filled vials.

5. The ski pole of claim 1, wherein the inclinometer comprises a projecting part that mates with a matching part on the grip to prevent rotation of the inclinometer.

6. The ski pole of claim 1, wherein the inclinometer comprises a scale of slope angles from approximately 30 degrees to approximately 48 degrees.

7. The ski pole of claim 1, wherein the inclinometer comprises a scale of slope angles from approximately 35 degrees to approximately 45 degrees.

8. The ski pole of claim 1, wherein the inclinometer comprises two slope angle readings of about 30 and about 48 degrees.

9. The ski pole of claim 1, wherein the inclinometer comprises two slope angle readings of about 35 and 45 degrees.

10. The ski pole of claim 1, wherein the grip and inclinometer are molded from a single piece of flexible plastic.

11. The ski pole of claim 1, wherein the inclinometer is placed below the grip.

* * * * *